US009204221B2

(12) United States Patent
Wen

(10) Patent No.: US 9,204,221 B2
(45) Date of Patent: Dec. 1, 2015

(54) ACOUSTIC METAL DIAPHRAGM

(71) Applicant: TRANSOUND ELECTRONICS CO., LTD, Dongguan (CN)

(72) Inventor: Tsengfeng Wen, Dongguan (CN)

(73) Assignees: TRANSOUND ELECTRONICS CO., LTD., Dongguan, Guangdong (CN); Tsengfeng Wen, Dongguan, Guangdong (CN)

( * ) Notice: Subject to any disclaimer, the term of this patent is extended or adjusted under 35 U.S.C. 154(b) by 0 days.

(21) Appl. No.: 14/539,020

(22) Filed: Nov. 12, 2014

(65) Prior Publication Data

US 2015/0172819 A1 Jun. 18, 2015

(30) Foreign Application Priority Data

Dec. 18, 2013 (CN) ..... 2013 1 0711913

(51) Int. Cl.
*H04R 7/10* (2006.01)
*H04R 7/12* (2006.01)

(52) U.S. Cl.
CPC ..... *H04R 7/122* (2013.01)

(58) Field of Classification Search
CPC ..... H04R 2307/025; H04R 2307/027; H04R 7/122; H04R 7/125
USPC ..... 181/167, 168
See application file for complete search history.

(56) References Cited

U.S. PATENT DOCUMENTS 4,129,195 A * 12/1978 Ishii ..... H04R 7/02 181/167
2005/0051380 A1* 3/2005 Takayama ..... B32B 27/36 181/170
2009/0038878 A1* 2/2009 Imamura ..... H04R 7/125 181/148
2011/0155501 A1* 6/2011 Chen ..... H04R 7/06 181/167
2014/0241567 A1* 8/2014 Crosby ..... H04R 9/025 381/412
2015/0075900 A1* 3/2015 Yuen ..... H04R 7/125 181/168

* cited by examiner

*Primary Examiner* — Jeremy Luks

(57) ABSTRACT

An acoustic metal diaphragm comprises a diaphragm base made of an organic material and a metal-plated layer. The diaphragm base has a smooth surface. The metal-plated layer is adhered to the smooth surface of the diaphragm base by an intermediate layer. The intermediate layer is disposed between the diaphragm base and the metal-plated layer. The metal-plated layer is made of pure beryllium or a beryllium alloy. Accordingly, the diaphragm base is made of the organic material and provided with a smooth surface. The intermediate layer allows the metal-plated layer to be adhered to the smooth surface more firmly. Using the pure beryllium or beryllium alloy to manufacture the metal-plated layer increases the rigidity of the diaphragm base and maintains the softness thereof to slow down the attenuation of the bandwidth, attain a wider frequency band, solve the problem of the high frequency and increase the quality of the sound.

9 Claims, 12 Drawing Sheets

ACOUSTIC METAL DIAPHRAGM

BACKGROUND OF THE INVENTION

1. Field of the Invention

This invention relates to a diaphragm field, particularly to an acoustic metal diaphragm which solves the problem of the high frequency and maintains the good quality of the sound.

2. Description of the Related Art

Generally, a sounding unit is a main component impinging on the sound quality of an earphone, and a diaphragm is a critical part for the sounding unit. The diaphragm is one of the important components in various acoustic devices, such as earplugs, earphones and microphones. There is a wide variety of diaphragms, such as paper diaphragms, plastic diaphragms, metallic diaphragms and synthetic fiber diaphragms. The conventional diaphragm is usually a single diaphragm shaped by one kind of material. The high frequency and the low frequency are usually created when the acoustic device make sounds. To solve the problem of the high frequency of the acoustic device, the conventional way is to print on the diaphragm, which increases the rigidity of the diaphragm. However, this way cannot ensure that the diaphragm gets softness and rigidity at the same time, with the result that the frequency response of the acoustic device cannot be wide enough and the sound quality or timbre thereof cannot be good enough. FIGS. 1-3 are respective graphs showing the curves of frequency response and noise (rub & buzz) for a big earphone, a microphone and a small earphone. From the graphs, the value of the sound pressure goes down straight and the bandwidth attenuates very fast when the sound frequency is above 10 KHZ, which causes a large decrease in the effect of the sound quality. Especially, shrill sounds may occur in the small earphone.

SUMMARY OF THE INVENTION

The object of this invention is to overcome the problems of the conventional structure presented supra and provide an acoustic metal diaphragm which solves the problem of the conventional printed diaphragm that renders the diaphragm unable to maintain its softness and poses the poor sound quality of the acoustic device.

To obtain the above object, the technique of this invention is described as follows:

An acoustic metal diaphragm in accordance with this invention comprises a diaphragm base and a metal-plated layer. The diaphragm base is made of an organic material. A surface of the diaphragm base is a smooth surface. The metal-plated layer is adhered to the smooth surface of the diaphragm base for covering by using an intermediate layer. The intermediate layer is disposed between the diaphragm base and the metal-plated layer. The metal-plated layer is made of pure beryllium or a beryllium alloy.

By comparison with the conventional structure, this invention has following advantages and effects:

By using an organic material to manufacture the diaphragm base and defining the smooth surface of the diaphragm base, the use of the intermediate layer allows the metal-plated layer to be adhered to the smooth surface of the diaphragm base more firmly. Concurrently, the metal-plated layer made of pure beryllium or a beryllium alloy can increase the rigidity of the diaphragm base and maintain the softness of the diaphragm base, thereby slowing down the attenuation of the bandwidth effectively, attaining the wider frequency band, solving the problem of the high frequency and obtaining the better quality of the sound. This invention can be applied to earphones, earplugs, speakers, microphones, etc.

DETAILED DESCRIPTION OF THE PREFERRED EMBODIMENTS

Figure 4:
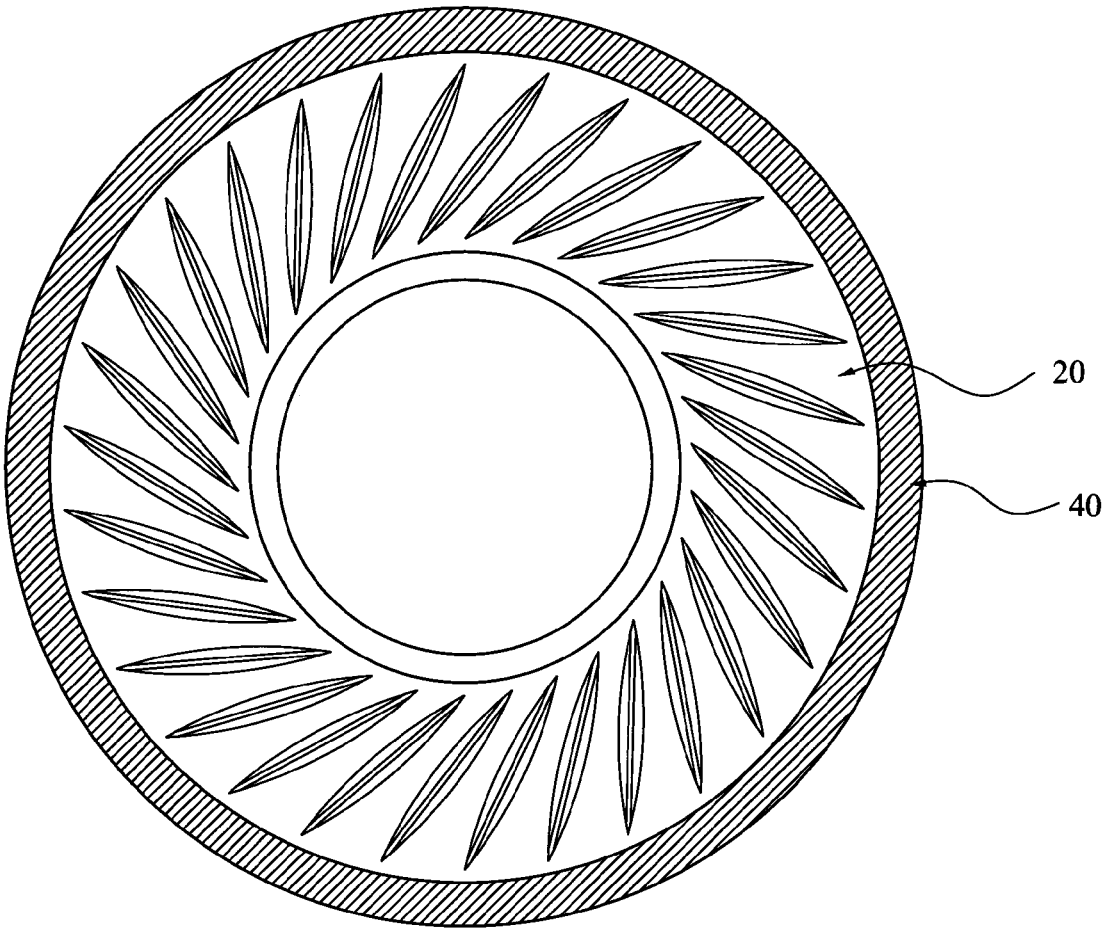
FIG. 4 is a top plan view showing a first preferred embodiment of this invention.
Figure 5:
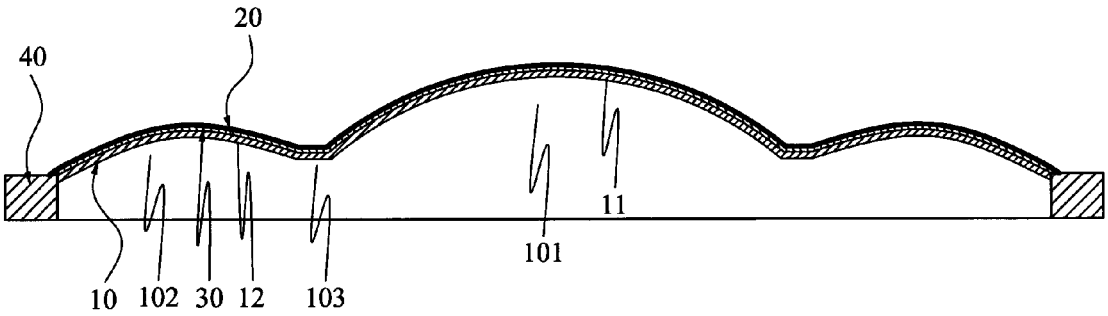
FIG. 5 is a cross-sectional view showing the first preferred embodiment of this invention.

FIGS. 4-5 show a first preferred embodiment of this invention which comprises a diaphragm base 10 and a metal-plated layer 20.

The diaphragm base 10 is a thin membrane. The diaphragm base 10 is made of an organic material. For example, the organic material can be PET (Polyethylene Terephthalate), PEN (Polyethylene Naphthalate), PPS (Polyphenylene Sulfide), PEI (Polyetherimide) or other materials. A surface of the diaphragm base 10 is a smooth surface. By using an intermediate layer 30, the metal-plated layer 20 is adhered to the smooth surface of the diaphragm base 10 whereby the metal-plated layer 20 covers the smooth surface of the diaphragm base 10. The intermediate layer 30 is disposed between the diaphragm base 10 and the metal-plated layer 20. The metal-plated layer 20 is made of pure beryllium or a beryllium alloy. The atomic number of beryllium is 4, and the standard atomic weight of beryllium is 9.012182. Beryllium is the lightest alkaline earth metallic element. Normally, beryllium is a steel-gray and lightweight metal whose weight is lighter than the common aluminum and titanium and whose strength is four times of the steel. Beryllium is a vital and precious material in the nuclear energy, rockets, guided missiles, the aircraft industry and the metallurgical industry because it has the best capability of being pervious to X-rays and also called "metallic glass". Beryllium is also an irreplaceable material for manufacturing the window material for X-ray equipment. Beryllium has the stable mechanical performance and the very high hardness, so it is the only metal as hard as the diamond and capable of cutting glass. By comparison with titanium metal, the hardness of the beryllium alloy is 3 times larger than titanium, the mass thereof is 1.5 times lighter than titanium and the conduction speed thereof is 3 times faster than titanium. The metal-plated layer 20 can cover a surface of the intermediate layer 30 by sputtering, evaporating or electroplating. In this preferred embodiment, the metal-plated layer 20 is formed on the intermediate layer 30 by sputtering in a closed space and thence adhered to the smooth surface of the diaphragm base 10 for covering, which allows the metal-plated layer 20 to be firmly adhered to the diaphragm base 10. Accordingly, the rigidity of the diaphragm base 10 is increased, and the softness of the diaphragm base 10 is also maintained.

The thickness of the metal-plated layer 20 is less than 2 μm. When the diameter of the diaphragm base 10 is 5-15 mm, the thickness of the diaphragm base 10 is less than 12 μm. When the diameter of the diaphragm base 10 is 15-60 mm, the thickness of the diaphragm base 10 is less than 25 μm. This invention utilizes the beryllium metal which has the hardest and lightest performance and the fastest response in the metallic elements. This diaphragm shows the physical advantages of the beryllium metal completely, such as its lightweight performance, rigidity and flexibility, whereby the actual effective audio range of the earphone becomes wider and the curve of the frequency response becomes smoother. Only the thickness of 2 μm can increase the audio range of the high frequency of the earphone from 10 KHz to about 20 KHz directly. In contrast, the conventional earphone becomes attenuating at 10 KHz. This invention allows the low frequency to extend more stably, allows the medium frequency to have higher sensitivity and allows the treble range to extend without shrillness. Therefore, the quality of the sound is upgraded and fine. For example, the bass range (low tone) is natural, rich and full, the transition between the bass and the mediant range (alto tone) is clear without ambiguity, and the treble range (high tone) is bright but not too outstanding, whereby the music is sweeter and worth listening. The ultra-high sensitivity also renders this invention to be in favour with high-grade audio brands.

The diaphragm base 10 comprises a central curved part 11 and an annular curved part 12 integrally connected to a periphery of the central curved part 11. A top of the central curved part 11 is higher than a top of the annular curved part 12. The central curved part 11 defines a treble region 101. The annular curved part 12 defines a bass region 102. A place where the central curved part 11 is connected to the annular curved part 12 defines a mediant region 103.

In this preferred embodiment, this invention further comprises a copper ring 40. The copper ring 40 is square in cross-section. An outer edge of the diaphragm base 10, an outer edge of the intermediate layer 30 and an outer edge of the metal-plated layer 20 are all connected to an inner edge of the copper ring 40.

Further, in this preferred embodiment, the diaphragm base 10, the intermediate layer 30, the metal-plated layer 20 and the copper ring 40 are all formed in a circular shape.

Figure 6:
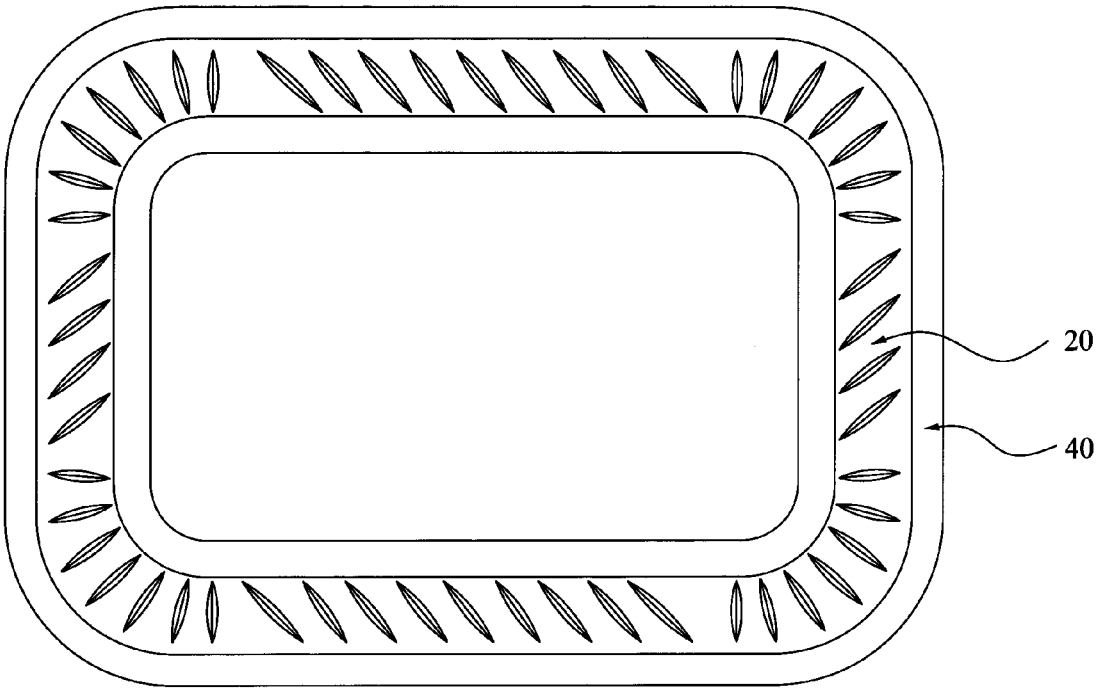
FIG. 6 is a top plan view showing a second preferred embodiment of this invention.
Figure 7:
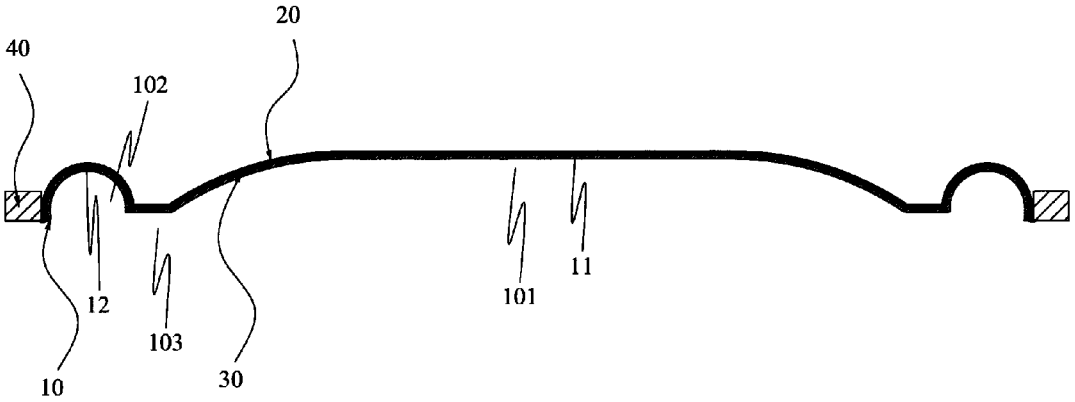
FIG. 7 is a lateral cross-sectional view showing the second preferred embodiment of this invention.
Figure 8:
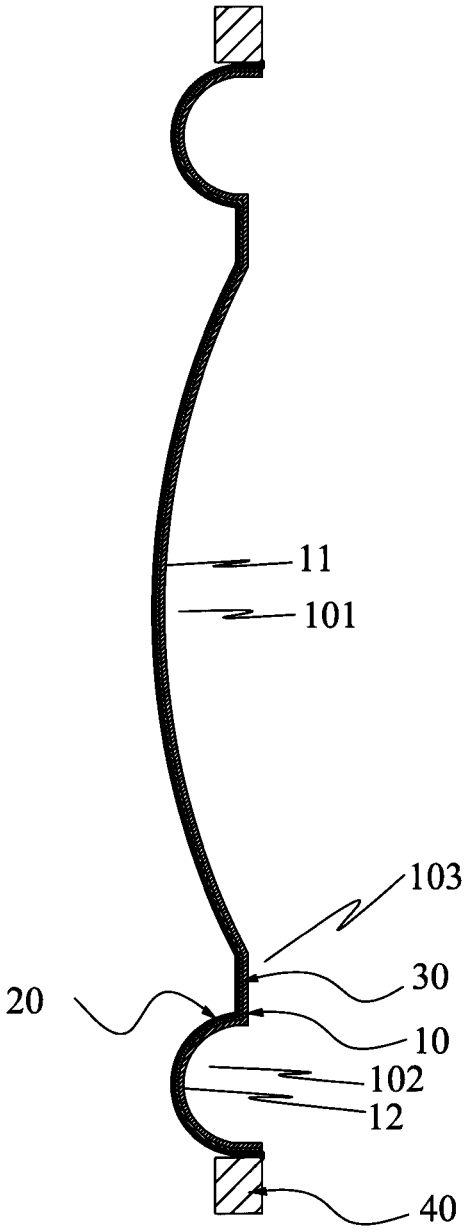
FIG. 8 is a longitudinal cross-sectional view showing the second preferred embodiment of this invention.

FIGS. 6-8 show a second preferred embodiment of this invention which still comprises the same elements as disclosed in the first preferred embodiment. The difference between the second embodiment and the first embodiment is that:

In the second preferred embodiment, the diaphragm base 10, the intermediate layer 30, the metal-plated layer 20 and the copper ring 40 are all formed in a rectangular shape.

Figure 9:
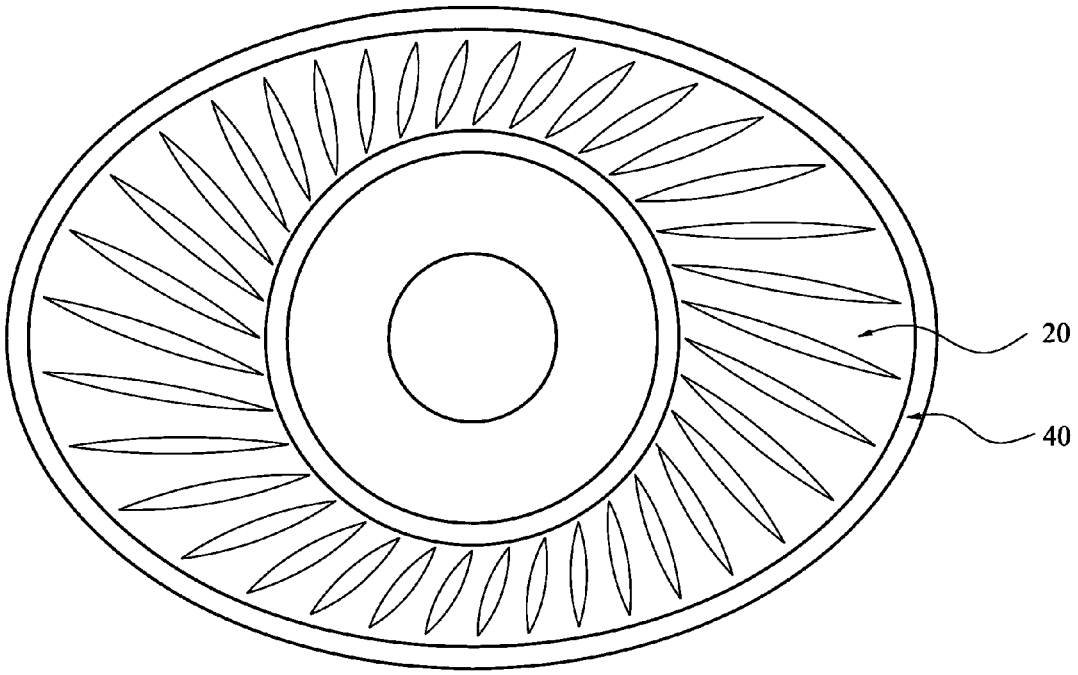
FIG. 9 is a top plan view showing a third preferred embodiment of this invention.
Figure 10:
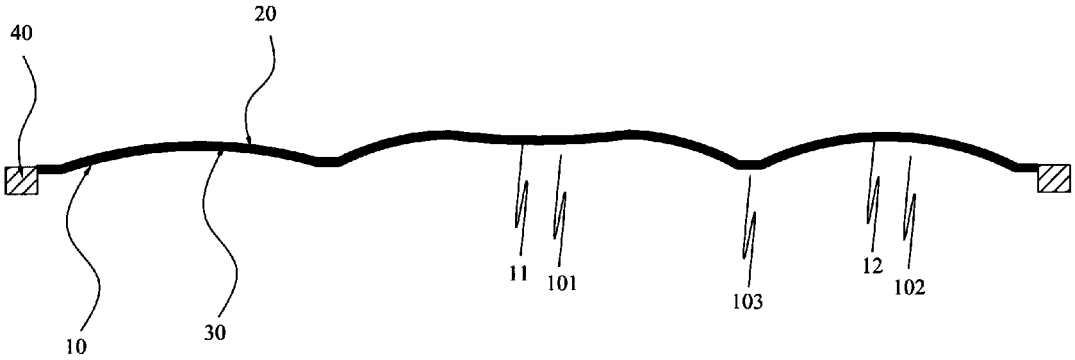
FIG. 10 is a lateral cross-sectional view showing the third preferred embodiment of this invention.
Figure 11:
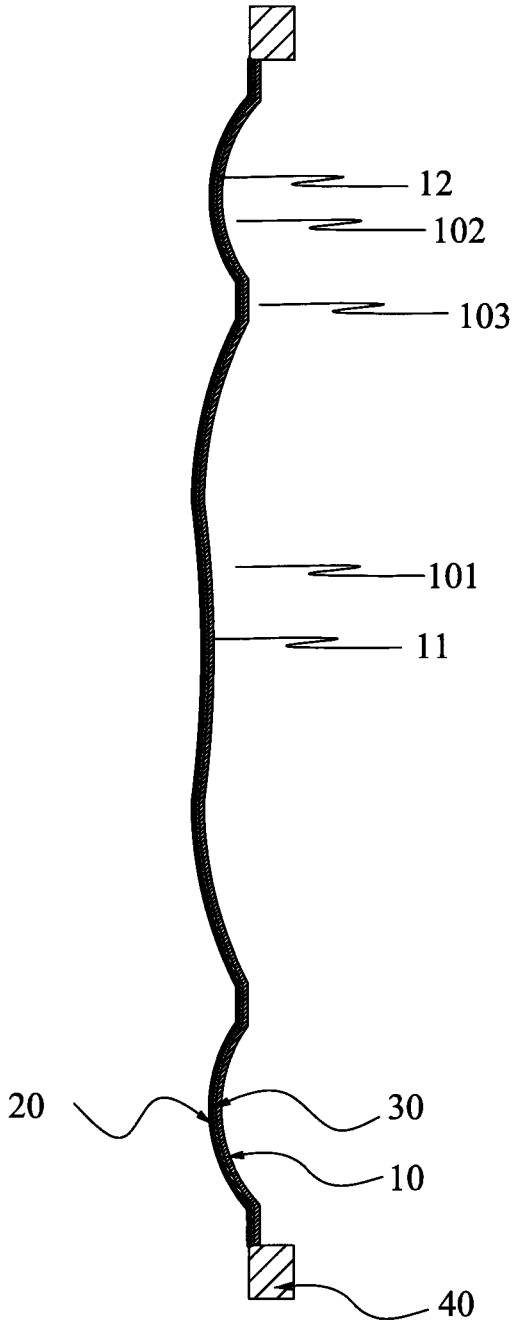
FIG. 11 is a longitudinal cross-sectional view showing the third preferred embodiment of this invention.

FIGS. 9-11 show a third preferred embodiment of this invention which still comprises the same elements as disclosed in the first preferred embodiment. The difference between the third embodiment and the first embodiment is that:

In the third preferred embodiment, the diaphragm base 10, the intermediate layer 30, the metal-plated layer 20 and the copper ring 40 are all formed in an elliptical shape. It is noted that the shape of the diaphragm base 10, the intermediate layer 30, the metal-plated layer 20 and the copper ring 40 is not limited.

Figure 1:
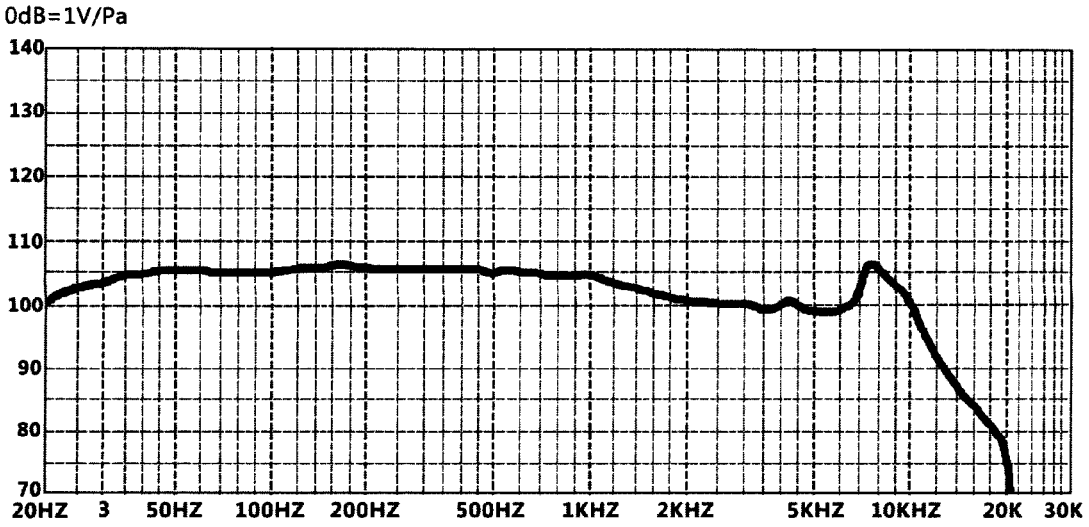
FIG. 1 is a graph showing the curve of the frequency response and noise (rub & buzz) of a conventional diaphragm applied to a big earphone.
Figure 2:
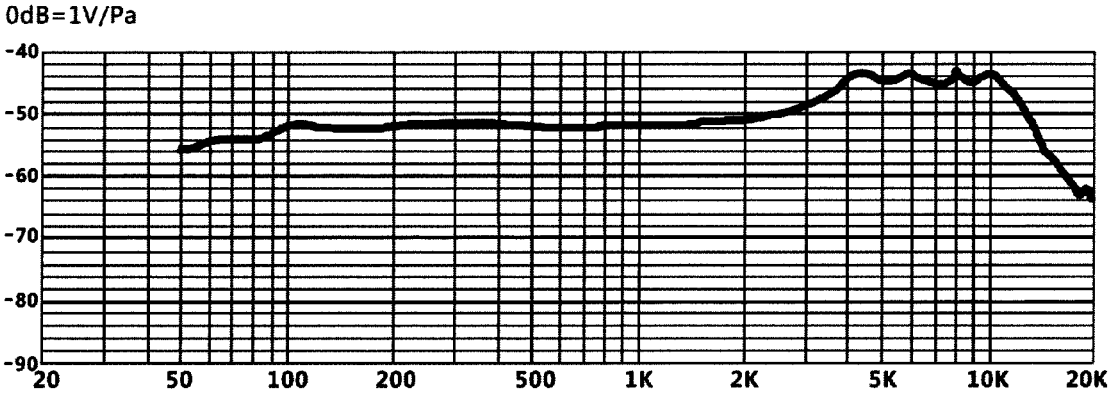
FIG. 2 is a graph showing the curve of the frequency response and noise (rub & buzz) of a conventional diaphragm applied to a microphone.
Figure 3:
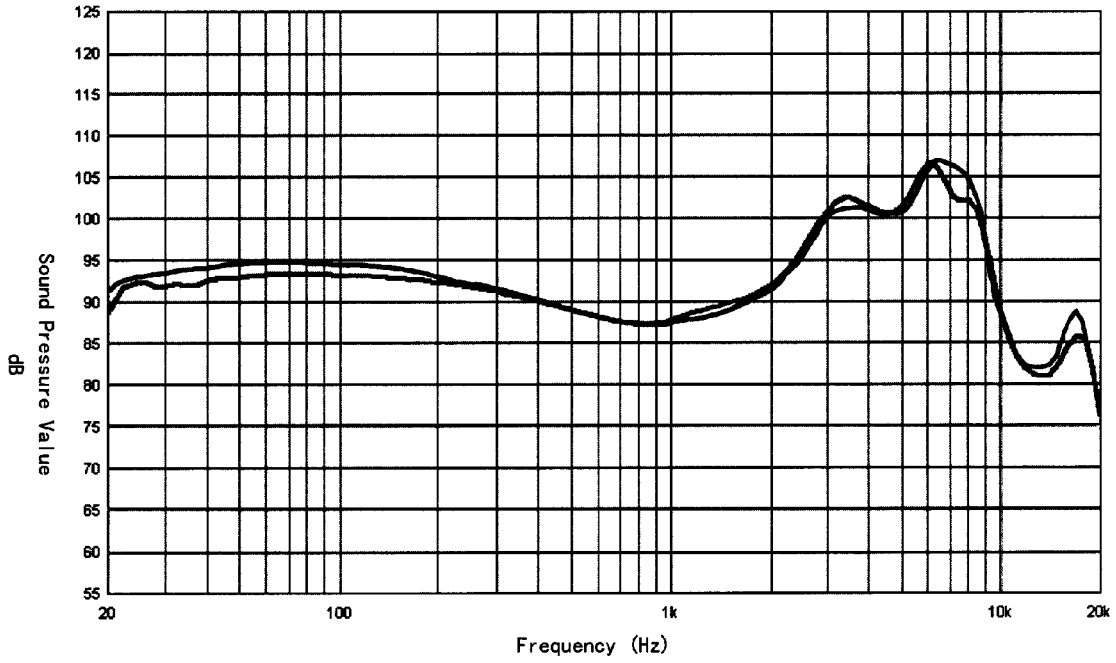
FIG. 3 is a graph showing the curve of the frequency response and noise (rub & buzz) of a conventional diaphragm applied to a small earphone.
Figure 12:
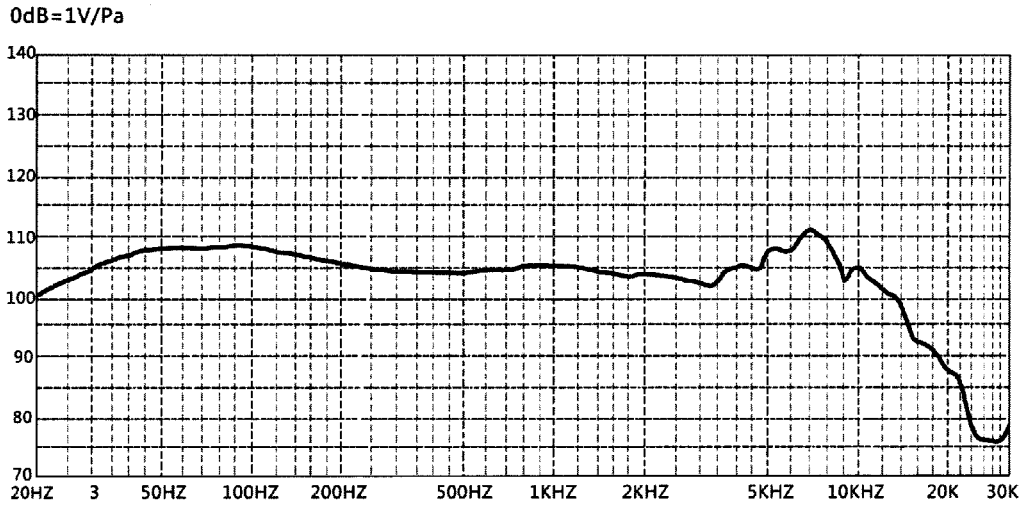
FIG. 12 is a graph showing the curve of the frequency response and noise (rub & buzz) of this invention applied to a big earphone.
Figure 13:
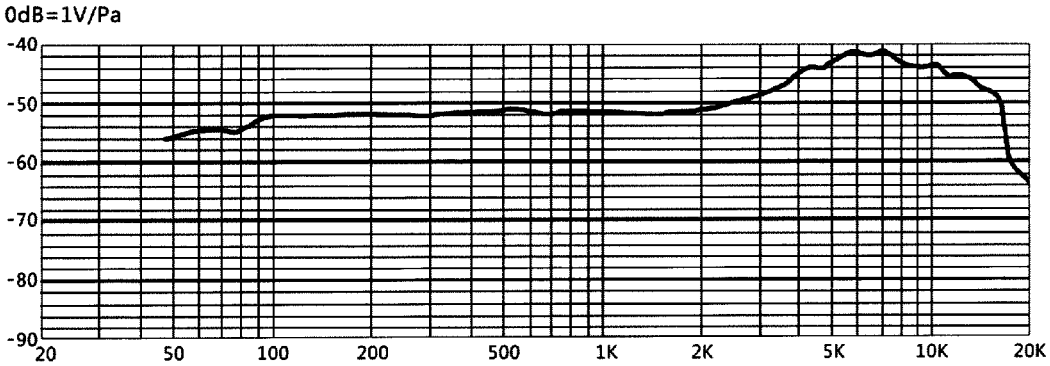
FIG. 13 is a graph showing the curve of the frequency response and noise (rub & buzz) of this invention applied to a microphone.
Figure 14:
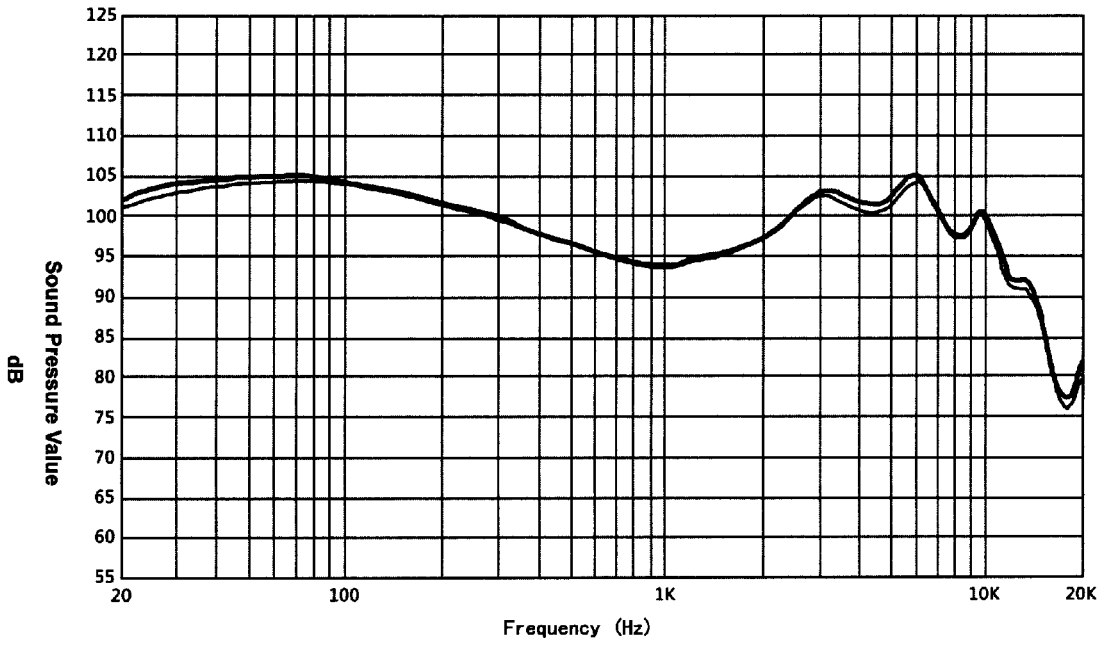
FIG. 14 is a graph showing the curve of the frequency response and noise (rub & buzz) of this invention applied to a small earphone.

FIGS. 12-14 show respective curves of the frequency response and noise (rub & buzz) applied to a big earphone, a microphone and a small earphone. By comparing FIGS. 12-14 with FIGS. 1-3, it can show that when the sound frequency is above 10 KHZ, the value of the sound pressure detected by this invention decreases gradually and the attenuation of the bandwidth slows down effectively. Therefore, the big earphone, the microphone and the small earphone can maintain the good quality of the sound to attain an unexpected result.

This invention utilizes the diaphragm base made of an organic material and provided with a smooth surface and uses the intermediate layer to render the metal-plated layer capable of being adhered to the smooth surface of the diaphragm base more firmly. Concurrently, pure beryllium or a beryllium alloy can be adopted to manufacture the metal-plated layer whereby the metal-plated layer increases the rigidity of the diaphragm base and also maintains the softness of the diaphragm base to slow down the attenuation of the bandwidth effectively, attain a wider frequency band, solve the problem of the high frequency and facilitate the better quality of the sound. This invention can be applied to various acoustic devices, such as earphones, earplugs, speakers and microphones.

While the embodiments in accordance with this invention are shown and described, it is understood that further variations and modifications may be made without departing from the scope of the invention.

What is claimed is:

1. An acoustic metal diaphragm comprising a diaphragm base and a metal-plated layer, said diaphragm base being made of an organic material, a surface of said diaphragm base being a smooth surface, said metal-plated layer being adhered to said smooth surface of said diaphragm base for covering by using an intermediate layer, said intermediate layer being disposed between said diaphragm base and said metal-plated layer, said metal-plated layer being made of pure beryllium or a beryllium alloy, wherein the acoustic metal diaphragm further comprising a copper ring, an outer edge of said diaphragm base, an outer edge of said intermediate layer and an outer edge of said metal-plated layer being all connected to an inner edge of said copper ring.

2. The acoustic metal diaphragm as claimed in claim 1, wherein said diaphragm base is a thin membrane, and said organic material is PET, PEN, PPS or PEI.

3. The acoustic metal diaphragm as claimed in claim 1, wherein said copper ring is square in cross-section.

4. The acoustic metal diaphragm as claimed in claim 1, wherein said diaphragm base, said intermediate layer, said metal-plated layer and said copper ring are formed in a circular shape, a rectangular shape or an elliptical shape.

5. The acoustic metal diaphragm as claimed in claim 1, wherein a thickness of said metal-plated layer is less than 2 μm.

6. The acoustic metal diaphragm as claimed in claim 1, wherein a diameter of said diaphragm base is 5-15 mm, and a thickness of said diaphragm base is less than 12 μm.

7. The acoustic metal diaphragm as claimed in claim 1, wherein a diameter of said diaphragm base is 15-60 mm, and a thickness of said diaphragm base is less than 25 μm.

8. The acoustic metal diaphragm as claimed in claim 1, wherein said diaphragm base comprises a central curved part and an annular curved part integrally connected to a periphery of said central curved part, a top of said central curved part being higher than a top of said annular curved part, said central curved part defining a treble region, said annular curved part defining a bass region, a place where said central curved part is connected to said annular curved part defining a mediant region.

9. The acoustic metal diaphragm as claimed in claim 1, wherein said metal-plated layer covers a surface of said intermediate layer by sputtering, evaporating or electroplating.

* * * * *